United States Patent [19]

Shiau

[11] Patent Number: 4,989,755

[45] Date of Patent: Feb. 5, 1991

[54] AUTOMATIC CLEANING-LIQUID DISPENSING DEVICE

[76] Inventor: Guey-Chuan Shiau, No. 4-3, Lane 123, An-Ho 1st St., Keelung City, Taiwan

[21] Appl. No.: 439,301

[22] Filed: Nov. 21, 1989

Related U.S. Application Data

[63] Continuation-in-part of Ser. No. 281,812, Dec. 20, 1988, abandoned.

[51] Int. Cl.[5] ..... B67D 5/08

[52] U.S. Cl. ..... 222/63; 222/642; 4/623; 4/624; 141/351; 141/360

[58] Field of Search ..... 222/52, 63, 642, 648, 222/649; 4/623, 624; 141/351, 348, 360, 361, 362

[56] References Cited

U.S. PATENT DOCUMENTS

| | | | |
|---|---|---|---|
| 3,368,717 | 2/1968 | Weber, III | 222/648 |
| 3,639,920 | 2/1972 | Griffen et al. | 4/623 |
| 3,739,944 | 4/1973 | Rogerson | 222/649 |
| 4,446,988 | 5/1984 | Chronis | 222/63 |
| 4,606,085 | 8/1986 | Davies | 4/624 |
| 4,645,094 | 2/1987 | Acklin et al. | 222/52 |
| 4,722,372 | 2/1988 | Hoffman et al. | 141/351 |
| 4,735,357 | 4/1988 | Gregory et al. | 4/623 |

FOREIGN PATENT DOCUMENTS

| | | | |
|---|---|---|---|
| 2644151 | 4/1978 | Fed. Rep. of Germany | 222/642 |
| 3231806 | 3/1984 | Fed. Rep. of Germany | 222/63 |

*Primary Examiner*—Michael S. Huppert
*Assistant Examiner*—Kenneth DeRosa
*Attorney, Agent, or Firm*—Varndell Legal Group

[57] ABSTRACT

An automatic cleaning-fluid dispensing device includes: a containing structure for containing cleaning fluid; a sensing device disposed on a base member being installed in the lower portion of said containing structure wherein said base member is provided with an outlet, a sensing circuit disposed on a circuit board, a motor arrangement electrically connected to the sensing circuit, an outlet for passing a light source of the sensing circuit therefrom so as to detect the presence of an external object closing on the light source; and a dispensing mechanism, which is composed of a push structure functionally connected with the driving motor and a pumping structure operatively engaged with the push structure, installed on the base member in connection with the sensing device; whereby when an external object closes to the sensing device, a given amount of the contained cleaning fluid in the containing structure will be automatically supplied for cleaning purposes.

2 Claims, 5 Drawing Sheets

AUTOMATIC CLEANING-LIQUID DISPENSING DEVICE

This is a continuation-in-part application of my copending application Ser. No. 286,812, entitled "INDUCTION TYPE AUTOMATIC EMULSION FEEDER," filed Dec. 20, 1988, now abandoned.

BACKGROUND OF THE INVENTION

This invention relates to an automatic cleaning-liquid dispensing device, and particularly to a type of cleaning-liquid dispensing device from which the contained cleaning liquid will be automatically fed in given amounts upon sensing the presence of an external object intended for receiving the cleaning liquid therefrom.

Soap or cleaning emulsion or other cleaning articles in public facilities are normally provided for the users to clean their hands. Because of direct contact with a user's hands necessary when using soap or cleaning liquids, the use of such cleansers in public facilities is not only inconvenient but also facilitates the spread of bacteria. In order to solve this problem, conventional automatic cleaning-liquid dispensing devices are produced for public use. However, since the construction of conventional automatic cleaning-liquid dispensing devices is generally composed of a cleaning liquid container and a pumping arrangement, external pressure has to be applied upon the pumping arrangement for cleaning-liquid dispensing purposes. As a result, either an excessive amount of cleaning liquid is supplied due to excessive pressure, or an insufficient amount of cleaning liquid is obtained due to insufficient pressure, causing great inconvenience to the users and eventual damage to the pumping arrangement.

SUMMARY OF THE INVENTION

It is accordingly a primary object of the present invention to provide an automatic cleaning-liquid dispensing device with photoelectric sensing arrangement for automatically detecting the presence of an external object and supplying the required cleaning liquid therefrom.

It is another object of the present invention to provide an automatic cleaning-liquid dispensing device by which the unidirectional drawing and feeding of the contained cleaning liquid is performed by contact with the rigid members thereof so as to extend the life expectancy of said apparatus.

These and other objects of the present invention are achieved by the provision of a preferred embodiment of an automatic cleaning-liquid dispensing device which comprises: a containing structure having an opening formed in a bottom portion thereof for containing cleaning liquid; a sensing device disposed on a base member and installed in the lower portion of said containing structure wherein said base member is provided with an outlet, a sensing circuit means disposed on a circuit board, a motor arrangement coupled with said sensing circuit means, an outlet for passing the sensing light of said sensing circuit means therefrom so as to detect the presence of an external object thereat and perform cleaning-liquid drawing operations therewith; and a dispensing mechanism composed of a push structure functionally connected with said driving motor and a pumping structure operatively engaged with said push structure, installed on said base member in connection with said sensing device, wherein said pumping structure includes a suction nozzle resiliently provided at one end thereof, an inlet port located at another end thereof in communication with said suction nozzle for being connected to the bottom opening of said containing structure, and a flowing tube communicatively connected to the outlet of said base member to allow for the flow of cleaning liquid out of said containing structure through said pumping structure; whereby, when an external object comes close to the lower side of said containing structure, said sensing device will actuate said driving motor which, in turn, drives said feeding mechanism to supply a given amount of the contained cleaning liquid through the bottom opening of said containing structure and automatically stop thereafter.

Other advantages and characteristics of the present invention will become apparent from the following detailed description of a preferred embodiment when read in conjunction with the accompanying drawings.

DETAILED DESCRIPTION OF THE PREFERRED EMBODIMENT

Figure 1:
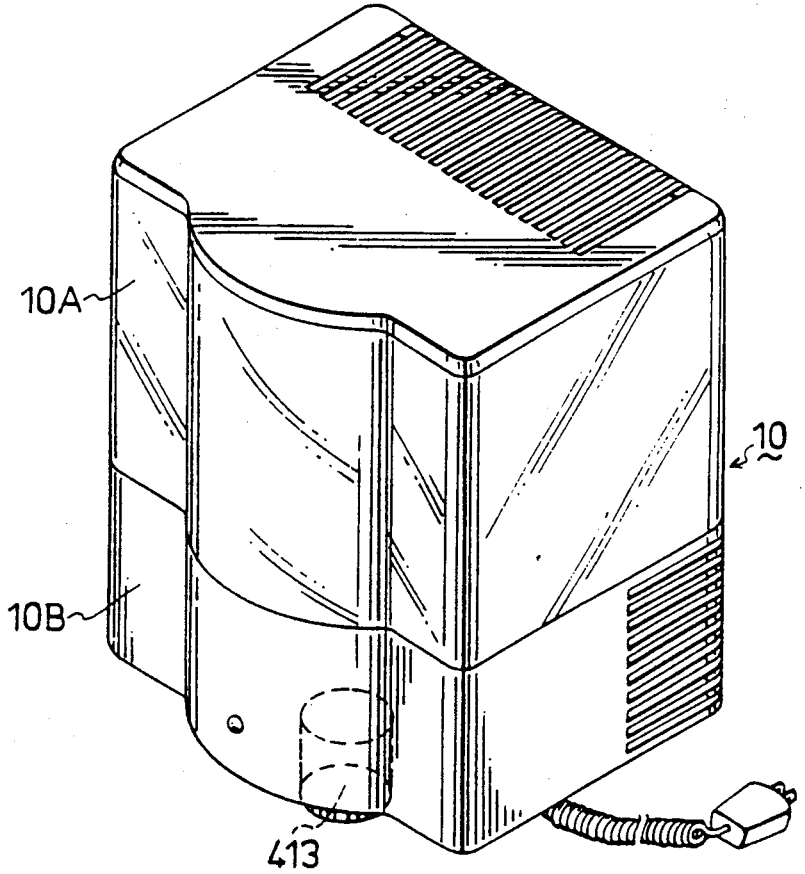
FIG. 1 is a perspective view of the assembled preferred embodiment of an automatic cleaning-fluid dispensing device according to the present invention.
Figure 2:
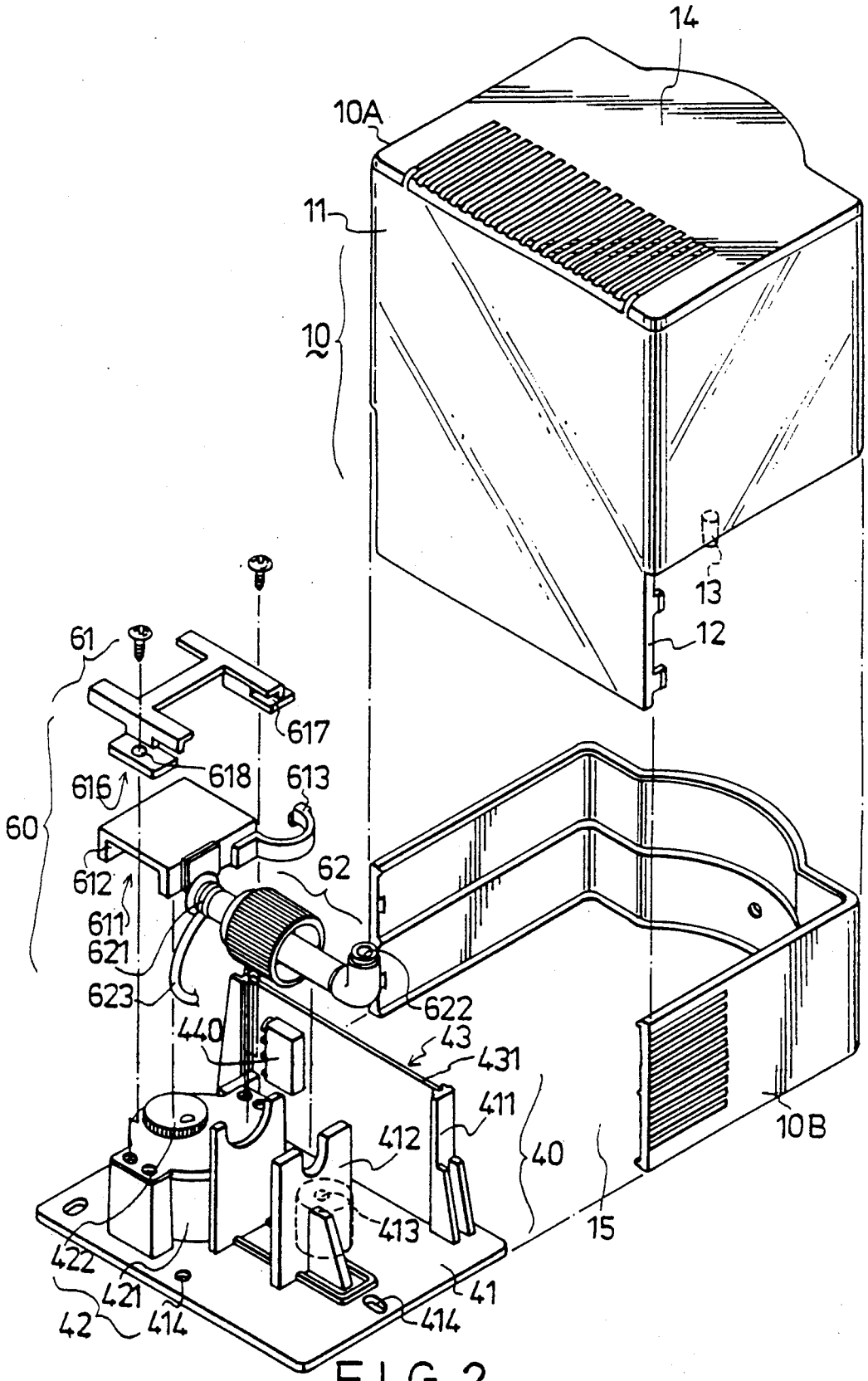
FIG. 2 is a perspective and exploded view of the preferred embodiment shown in FIG. 1.
Figure 3:
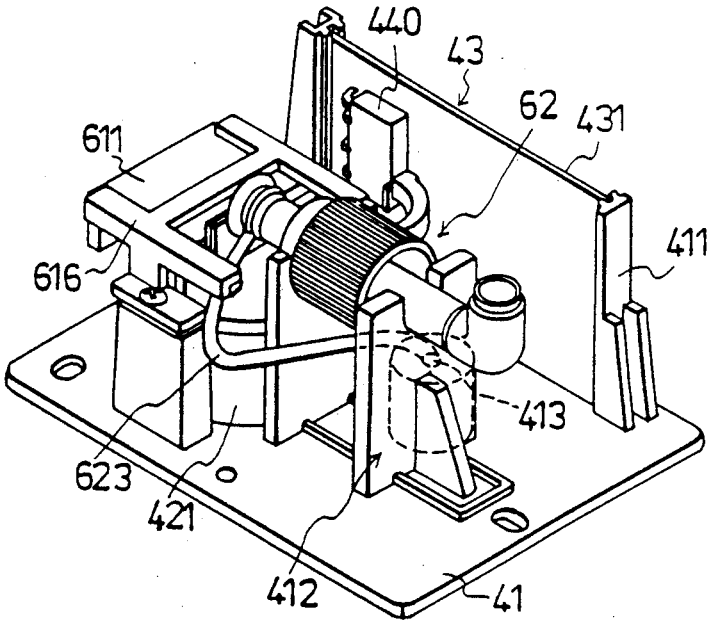
FIG. 3 is perspective view showing the combination of a sensing device and a dispensing mechanism of the preferred embodiment shown in FIG. 2.

Referring to FIGS. 1, 2 and 3, the preferred embodiment of an automatic cleaning-fluid dispensing device according to the present invention comprises a combination of a containing structure 10, a sensing device 40 and a dispensing mechanism 60.

As shown in FIG. 2, the containing structure 10 includes: an upper containing unit 10A for accommodating the cleaning fluid (not shown) therein, having a cover detachably disposed on a top side thereof, a rear side wall 11 extended downward to form a protruding portion 12 thereat and a cleaning-fluid orifice 13 located in the bottom side thereof; and a lower housing 10B formed in conjunction with said upper containing unit 10A, having an open section 15 provided at the rear side thereof for being coupled with the protruding portion 12 of said upper containing unit 10A.

The sensing device 40 comprises a base plate 41, a motor arrangement 42 and a sensing circuit means 43. The base plate 41, which is formed in conjunction with the lower housing 10B, has a first support member 411, a second support member 412, an outlet 413 and a plurality of fitting openings 414, respectively provided thereon for being installed in the bottom side of said lower housing 10B. The motor arrangement 42 includes a driving motor 421 and an eccentric gear 422, serving as a reciprocating member, connected to the motor shaft (not shown) and located at a top end of said driving motor 421. The sensing circuit means 43 is composed of a microswitch 440 electrically coupled with said driving motor 421 and a photoelectric sensing circuit, (to be described later), disposed on a circuit board 431 which is positioned on said first support member 411 with light-emitting and photosensitive elements provided at a lower side of said circuit board 431 and located nearby the outlet 413 of said base plate 41 for emitting light downward therefrom so as to enable the sensing of the presence of an external object, (such as a user's hand), and effect cleaning-fluid dispensing operations therewith.

The dispensing mechanism 60 includes a combination of push structure 61 and a pumping structure 62. The push structure 61, which is positioned on top of said driving motor 421, includes a push member 611 and a guide frame 616. The push member 611 is provided with an inside open recess 612 for being situated on top of the eccentric gear 422 of said motor arrangement 42 and an arch-shaped member 613 fixed on the back side of said push member 611 for being moved along to make contact with the microswitch 440 provided on the circuit board 431 of said sensing device 40. The guide member 616, which is formed in conjunction with said push member 611, includes a sliding slot 617 along which said push member 611 is slidingly engaged, and a plurality of screw holes 618 through which said guide member 616 is fixed onto said driving motor 421 so as to enable said push member 611 to be pushed to move left and right by the eccentric gear 422 of said driving motor 421.

The pumping structure 62, which is installed on the second support member 412, as shown in FIG. 3, includes: a suction nozzle 621 resiliently provided at one end thereof; an inlet port 622 located at another end thereof in communication with said suction nozzle 621 for being communicatively connected to the cleaning fluid orifice 13 of said upper containing unit; and a flow tube 623 communicatively linked between said suction nozzle 621 and the outlet 413 of said base plate 41.

Figure 5:
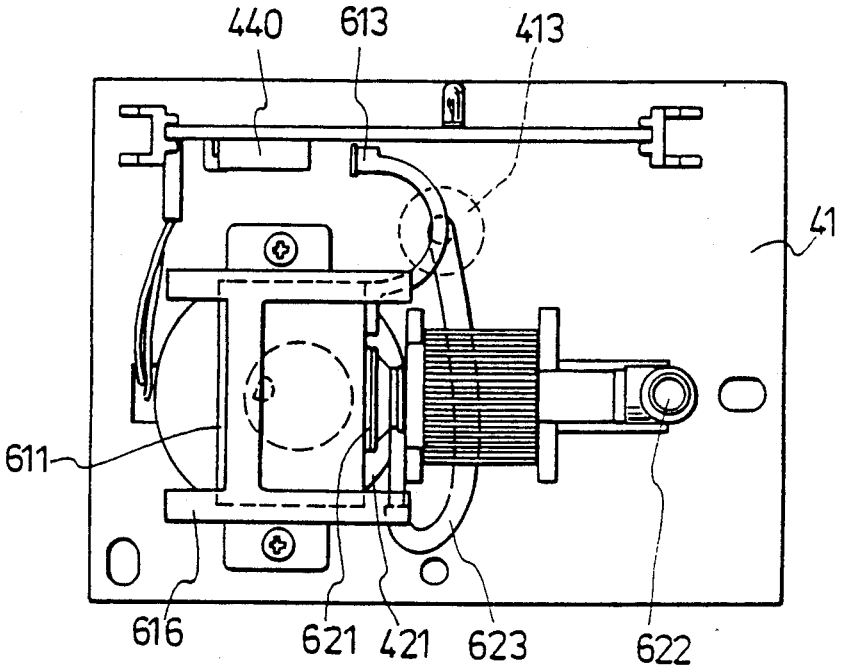
FIG. 5 is a schematic illustration of said dispensing mechanism of the preferred embodiment.

Referring to FIG. 5, after the assembly of said sensing device 40 and said dispensing mechanism 60 on the base plate 41 is completed, said base plate 41 is installed on the bottom side of said lower housing 10A wherein the inlet port 622 of said dispensing structure 60 is communicatively connected to the cleaning fluid orifice 13 of said upper containing unit 10A and the suction nozzle 621 is resiliently attached on the back side of said push member 611. Whereby, when the driving motor 421 is actuated, the eccentric gear 422 will push said push member 611 to apply pressure to said suction nozzle 621 and then remove the pressure therefrom, causing the contained cleaning fluid in said upper containing unit 10A to flow out in a given amount for cleaning purposes.

Figure 4:
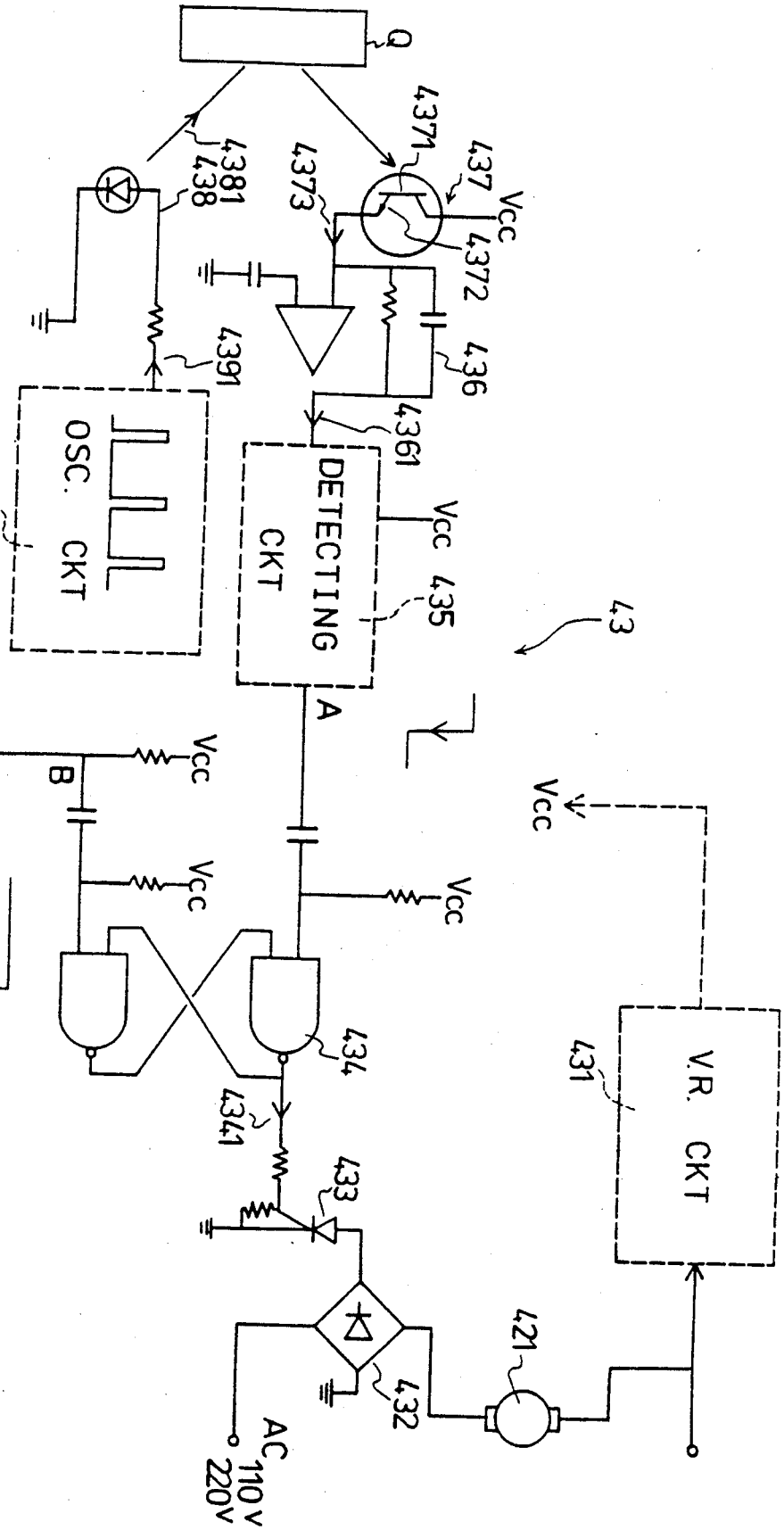
FIG. 4 is a circuit diagram and an operational illustration of said sensing device of the preferred embodiment.

Referring to FIG. 4, the sensing circuit means 43 of said sensing device 40 includes: a voltage regulating circuit 431 for providing the required voltage level for the driving motor 421; a bridge rectifier 432 connected between said driving motor 421 and an external A.C. power source (110 V or 220 V) for supplying the rectified D.C. power therefrom; a silicon controlled rectifier (SCR) 433 connected to said bridge rectifier 432 to serve as a D.C. switch thereat; a bistable circuit 434 coupled with said SCR 433 for controlling the gate thereof with an output of either a high-level or low-level from said bistable circuit 434 in order to turn on and off the entire loop circuit connected thereto; a detecting circuit 435 connected to said bistable circuit 434 for performing signal detection and amplification thereat; an operational amplifier 436 coupled with said detecting circuit 435 for inputting current signal and outputting amplified voltage signal thereat; a phototransistor connected to said operational amplifier 436 for being actuated to emit light current therefrom; a light-emitting diode (LED) 438 disposed for emitting light thereat; an oscillating circuit 439 coupled with said LED 438 for outputting an oscillatory pulse therefrom; and a microswitch circuit 440 connected between said bistable circuit 434 and said driving motor 421 for being actuated to turn on and off said driving motor 421. Operations of said sensing circuit means 43 are as follows:

When the SCR 433 remains at an off-state and said oscillating circuit 439 continuously outputs pulses 4391 therefrom, said LED 438 will be energized to emit a light source 4381 which, on being struck upon an external object (Q), will be reflected, as shown in FIG. 4, onto the base 4371 of said phototransistor 437, producing a forward bias 4372 thereat to enable said phototransistor to output a photocurrent 4373 to said operational amplifier 436. After the wave form of said photocurrent 4373 is amplified by said operational amplifier 436, a voltage signal 4361 is fed into said detecting circuit 435 and is output therefrom. As a result, the potential level at point (A) is changed from a high-level to a low-level thereat, causing said bistable circuit 434 to output a high-level signal 4341 to the gate of said SCR 433 which is therefore actuated to start said driving motor 421. Thus, the eccentric gear 421, (as shown in FIG. 2), located on top of said driving motor 421 will be turned to rotate and push said push member 611 to sway left and right thereat. While, when said eccentric gear 421 completes a rotation cycle along with said driving motor 421, the arch-shaped member 613 will be moved to contact the microswitch 440 and turn off the electric power therefrom. In this condition, the output of said bistable circuit 434 will also be changed to a low level and impressed across the gate of said SCR 433 so that said SCR is cut off and said driving motor 421 stops thereat with the entire sensing circuit means 43 recovered to the initial state. When another external object is placed before said LED 438, the above-described operations will be repeated in a complete cycle.

As shown in FIGS. 2, 3 and 5, when a user's hand closes onto said sensing circuit means 43, said driving motor 421 will be started so as to drive said eccentric gear 422 to rotate thereat. The rotation of said eccentric gear 422 will push said push member 611 to sway left and right. Thus, when the push member 611 moves to the right, it will press forward the suction nozzle 621 of said pumping structure 62 to effect cleaning fluid drawing operations while, when the push member 611 moves to the left, said suction nozzle 621 will automatically return to the original position thereof through the resilient arrangement thereof, causing the contained cleaning fluid in said upper containing unit 10A to flow through the bottom opening 13 thereof to the inlet port 622 from which a given amount of the cleaning fluid flows out of the outlet 413 of said base plate 41 and drops onto the user's hand presented thereat. As described above, after said eccentric gear 422 has completed a rotation cycle, the arch-shaped member 613 will be moved to turn off said microswitch 440, thus said driving motor 421 stops and the sensing circuit 43 recovers to the initial state, ready for effecting next cleaning-fluid supply operation.

While a preferred embodiment has been illustrated and described, it will be apparent that many changes may be made in the general construction and arrangement of the invention without departing from the spirit thereof. Therefore, it is desired that the invention be not limited to the exact disclosure but only to the extent of the appending claims.

What is claimed is:

1. An automatic cleaning-fluid dispensing device comprising:

a containing structure having an upper containing unit for containing cleaning fluid therein, a cleaning fluid orifice located in a bottom side of said upper containing unit and a lower housing having an open section in a back side thereof connected to said bottom side;

a sensing means located within said open section of said lower housing for performing external-object sensing operation; said sensing means including a base plate having an outlet formed in conjunction with said open section of said lower housing, a motor arrangement including an eccentric gear driven by a driving motor, and a microswitch for actuating said motor arrangement; and a dispensing means installed in said lower housing and having a push structure functionally connected with said sensing means for providing a sway action and a pumping structure operatively engaged with said push structure for drawing cleaning fluid from said upper containing unit according to said sway action of said push structure; said push structure positioned on top of said driving motor and formed with a push member and a guide frame, said push member including an inside open recess situated on top of said eccentric gear of said motor arrangement and an arch-shaped member fixed on a back side of said push member for making contact with said microswitch of said sensing means, and said guide member fixed onto said driving motor and having a sliding slot slidingly engaging said push member so as to provide said sway action by enabling said push member to be pushed to sway left and right by action of said eccentric gear of said driving motor thereon; said pumping structure supported by said base plate and including a suction nozzle resiliently provided at one end thereof, an inlet port located at another end thereof in communication with said suction nozzle and communicatively connected to said cleaning fluid orifice of said upper containing unit, and a flow tube communicatively linked between said suction nozzle and said outlet of said base plate; so that when an external object under said lower housing is sensed by said sensing means, said sensing means will be energized to rotate said driving motor causing said eccentric gear to push said push member to sway left and right against said suction nozzle to supply a given amount of cleaning fluid from said upper containing unit onto the external object for cleaning purposes, as well as to turn off said driving motor to stop flow of said cleaning fluid.

2. An automatic cleaning-fluid dispensing device according to claim 1 wherein said sensing means further comprises:

said base plate having a first support member, a second support member for supporting said pumping structure, and a plurality of fitting openings respectively provided thereon, installed in the bottom side of said lower housing through said open section thereof;

said eccentric gear said of motor arrangement connected to a motor shaft of said driving motor and located at a top end of said motor arrangement for being actuated to rotate thereat; and a sensing circuit disposed on a circuit board, having said microswitch as a part thereof electrically coupled with said driving motor and photoelectric elements arranged thereon, fixed on said first support member of said base plate with said photoelectric elements located near said outlet of said base plate for emitting detecting light therefrom so as to sense the presence of the external object and actuate said motor arrangement therewith.

* * * * *